US005372414A

United States Patent [19]

Lamonakis et al.

[11] Patent Number: 5,372,414

[45] Date of Patent: Dec. 13, 1994

[54] TOWEL-HOLDER COMBINATION FOR USE IN OUTDOOR SPORTS

[76] Inventors: Nicholas E. Lamonakis, 330 Commonwealth Ave., Concord, Mass. 01742; Daniel G. Sweeney, 78 Century Mill Rd., Bolton, Mass. 01740

[21] Appl. No.: 981,830

[22] Filed: Nov. 25, 1992

[51] Int. Cl.[5] ..... A47K 10/00

[52] U.S. Cl. ..... 312/3; 312/34.1; 312/239; 15/209.1; 150/154; 206/315.1; 206/812

[58] Field of Search ..... 206/315.1, 581, 493, 206/494, 495, 812; 312/3, 34.1, 239, 352; 150/154; 15/209.1

[56] References Cited

U.S. PATENT DOCUMENTS

| | | | |
|---|---|---|---|
| 4,516,616 | 5/1985 | Fesler | 206/315.9 |
| 4,771,502 | 9/1988 | Trimble | 15/209.1 |
| 4,811,767 | 3/1989 | Kessler | 150/154 |
| 4,953,603 | 9/1990 | Holden | 150/154 |
| 5,161,683 | 11/1992 | Smith | 206/315.1 |

FOREIGN PATENT DOCUMENTS

| | | | |
|---|---|---|---|
| 1502737 | 10/1967 | France | 150/154 |
| 3903 | 2/1906 | United Kingdom | 312/3 |

*Primary Examiner*—P. W. Echols
*Assistant Examiner*—David P. Bryant

[57] ABSTRACT

A towel and towel holder combination for outdoor use in sports provides the user with a dry towel in spite of falling rain and water impinging against the holder includes a substantially upright towel holder that is closed at the top and open at the bottom and provides a protected space within for containing a towel to which there is access through the open end, the towel being attached to the holder and contained in the protected space, the holder being made of flexible water repelling material and the towel being water absorbent material on the inside of the holder so that when it is turned inside-out, the towel is exposed for use.

3 Claims, 2 Drawing Sheets

TOWEL-HOLDER COMBINATION FOR USE IN OUTDOOR SPORTS

BACKGROUND OF THE INVENTION

The present invention relates to towels and towel holders for use in outdoor sports to provide a dry towel for a player or a referee (official) on the sport field of play for wiping and drying hands, face, etc., and/or equipment. In particular, the towels and towel holders of the present invention are useful to a golf player and others who play their game in the rain.

In all sports, indoor and outdoor, towels are used by the players and officials to wipe off hands, faces, etc. and equipment used in playing the game. For indoor sports, it is sufficient to simply supply an abundance of towels available to the players and officials for use whenever they feel the need. The players usually use the towel to wipe off their hands and face and the officials usually use the towel to wipe off the ball as in basketball or they may wipe moisture from the playing surface. For outdoor sports, the same use has been made of an abundant supply of towels by both the players and officials.

However, for outdoor sports, these problems are exacerbated by weather conditions. A wet playing field and/or falling rain or snow during play requires more use of towels for all of the above mentioned purposes and towels that become wet are useless. Keeping such towels dry and available along the sidelines of the playing field is no problem; they are merely kept undercover. However, the player or official who carries a towel on the playing field frequently finds that the towel has become too wet for use simply due to falling rain or snow and so must change the towel, in some cases, even before it is used, because it is too wet for use and this interferes with the play. It is an object of the present invention to provide a towel and towel holder combination that can be readily carried by a player or an official in an outdoor sport on the playing field whereby the towel is shielded from falling rain or snow.

The game of golf is played just about all times of the year and is, of course, an outdoor game, and the golf player is seldom near any stationary supply of towels and so must carry one if the player wants to use one at all. For the average golf player, carrying a towel is usually no problem, because the player is himself carrying or has a caddy carrying a bag of golf clubs and other equipment from the start to the end or a round of golf and the towel can be conveniently with that equipment. The towel is used by the player frequently throughout the three to five hour time it takes to play a round of golf. Even in clear weather, the fairways and greens of a golf course are often wet with dew early in the day and a player must frequently use the towel to wipe off (dry) his club heads and golf balls. Play seldom stops because of a slight amount of rain, bringing on even more frequent use of the towel to wipe off the club handles and the player's hands. The player loses a great deal of control when his hands are wet or when the handles of his clubs are wet and he cannot dry them adequately. Here as in outdoor field sports, the towel that is carried by the player or official that becomes wet is useless. It is another object of the present invention to provide a towel-holder combination that can be readily carried by a golfer to provide the golfer with a towel that is not wet by falling rain.

SUMMARY OF THE INVENTION

It is an object of the present invention to provide a towel-holder combination for use in outdoor sports to provide a towel for immediate use by a player or an official on the playing field that is not wet by falling rain or snow and may even contact the wet ground and not be wet by the contact.

It is another object to provide such a towel-holder combination wherein the towel can be readily removed from the holder for use and/or for replacement.

It is another object to provide such a towel-holder combination wherein the towel can be readily used to dry hands face or equipment without removing the towel from the holder.

It is another object of the present invention to provide a towel and towel holder combination that can be readily carried by a player or an official in an outdoor sport on the playing field whereby the towel is shielded from falling rain or snow.

It is another object of the present invention to provide a towel-holder combination that can be readily carried by a golfer to provide the golfer with a towel that is not wet by falling rain.

It is another object to provide such a towel-holder combination wherein the holder intimately encloses the towel so that the combination is not much bulkier than the towel itself and the resilience of the holder allows the towel to be easily pulled from the holder for use without detaching the towel from the holder and after use, the towel can be easily pulled back into the holder wherein it is protected from falling rain.

It is another object to provide a towel of water absorbing material and water repelling material so constructed and shaped that the water absorbing material thereof is readily available for drying and the water repelling material thereof shields the water absorbing material thereof from falling rain when the towel is not in use.

According to embodiments of the present invention, the towel and towel holder combination provided for any of the uses mentioned above includes a substantially upright towel holder that is closed at the top and open at the bottom and provides a protected space within for containing one or more towels to which there is access through the open end and so long as the holder with the towels is held substantially upright, falling rain does not reach the towels.

In all embodiments, the towels are attached to the holder at the top of the protected space in such a way that they can be easily removed and replaces. Furthermore, ready access to the towels contained in the holder can be enhanced by making the holder capable of being opened further for greater access to the towels and then closed again after using the towels to continue again to protect the towels from falling rain.

In one embodiment the holder is made of flexible resilient material so that it can be turned inside-out to completely expose the towels for use and then reversed to again protect the towels. In a preferred embodiment, the towels are attached inside the holder to a captured ring at the top inside of the holder, the ring being captured in an annular space that is formed by a grommet that is inserted and secured from the outside of the holder and so the ring encircles the grommet post. Furthermore, the ring contains a part that can be opened like a shower curtain ring so that one or more towels can be attached to and detached from the ring.

These and other objects and features of the present invention will be apparent to those skilled in the art from the following description of specific embodiments of the invention taken inn conjunction with the drawings.

DESCRIPTION OF EMBODIMENTS OF THE INVENTION

Figure 1:
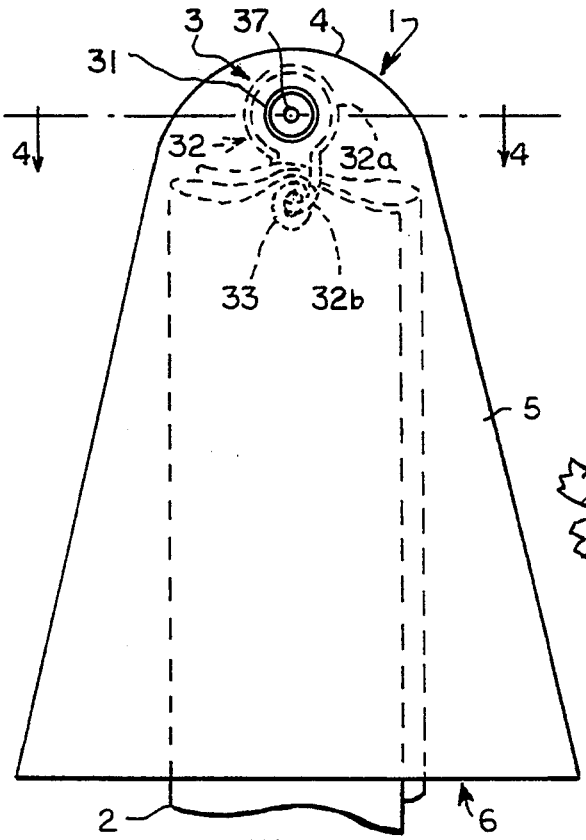
FIG. 1 is a front view of the combination towel and towel holder.
Figure 7:
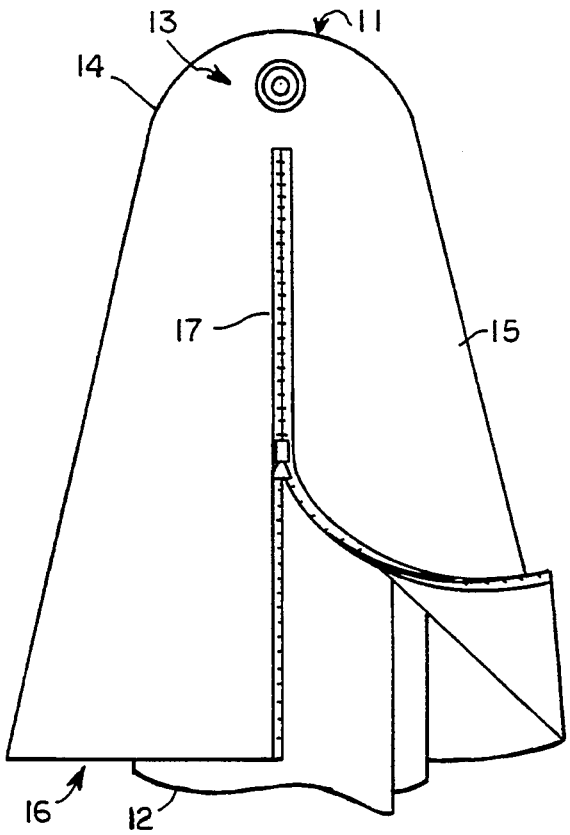
FIG. 7 is a front view of the combination towel and towel holder equipped with a zipper that is manipulated to open and close the holder for greater access to the towel.

In FIG. 1 the towel holder i is shown in an upright position holding one or more towels 2 inside the towel holder so that they are protected from falling rain. For that purpose, the towel holder is made of sheet material that is preferably flexible and is water repellant at the outside surface thereof. The shape of the towel holder is generally upright, bell-shaped having a top end 4 and skirt 5 so that there is ready access to the towel 2 at the bottom of the holder through the large bottom opening 6. This configuration affords sufficient access to the towel for most purposes. For example, the user can readily wipe his hands on the towel by reaching into the large open end with the towel-holder combination held upright as shown or turned upside down. The user can also wipe off golf club handles and heads and golf balls by reaching the towel through the large open end. Thus for many if not most uses of a dry towel the bell shaped configuration shown provides sufficient access to the towels.

Where the user uses the towels to wipe off a large ball like a football, it may be preferred to provide even greater access to the towel inside the holder and for that purpose a zipper 17 may be provided as shown in FIG. 7 to open up the holder 11 even more. For such a zippered holder 11, as shown in FIG. 7, to be effective, it should be closeable so that even pouring rain does not leak through it and wet towel 12 and the zipper should extend from the top end 14 to the rim 17 of the bottom opening 16. Thus, the zipper opens the skirt 15 of the holder. The zipper seems to offer the best performance in that respect. Other closures that can be opened using snaps, buttons or Velcro closures are less likely to prevent falling rain from leaking through to the towels, unless there is a substantial overlap at the closure.

Figure 8:
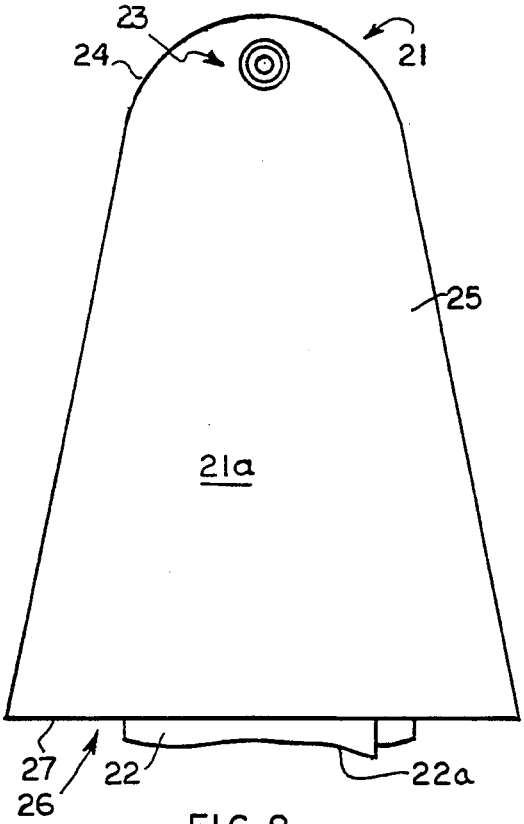
FIG. 8 is a front view of a combination towel and towel holder in which the towel holder is made of flexible resilient material.
Figure 9:
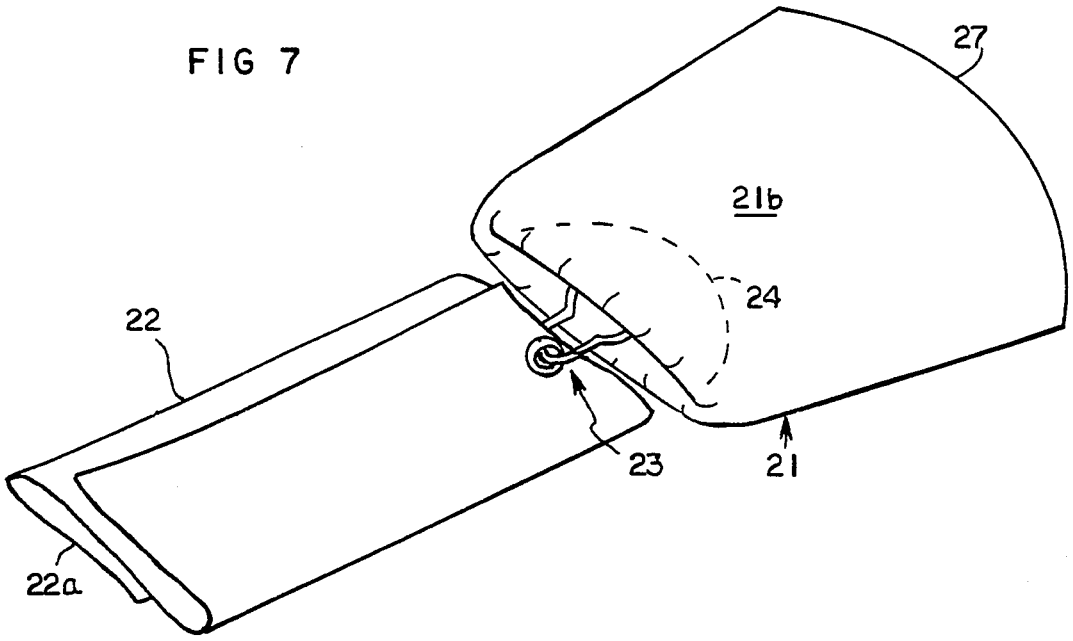
FIG. 9 shows the combination towel and towel holder of FIG. 8 with the holder turned inside-out to provide greater access to the towels.

Another technique that allows greater access to the towel 22 in the holder 21 is illustrated by FIGS. 8 and 9. Here, the holder 21 is made of flexible, resilient material so that it can be easily turned inside-out as shown in FIG. 9, giving full access to the towel. The user accomplishes this by grasping the end 22*a* of towel 22 that is reached through the large opening 26 at the bottom of holder 21 with one hand and taking hold of the bottom edge 27 of the holder with the other hand and then simply peeling back the holder, turning the skirt 25 inside-out, to completely expose towel 22, as shown in FIG. 9. Thus, the holder inside surface 21*b* is turned out or reversed sufficiently that all of the towels hangs outside the holder.

In this configuration, additional moisture absorbing surface to supplement the towels can be provided by the inside surface 21*b* of the holder; that surface can be made of water absorbing material, while the outside surface 21*a* of holder 21 is made of water repellant material. Thus, the entire fabric of the towel and the holder that is exposed as shown in FIG. 9 can be used to wipe things dry. Then, after use, the user reaches inside the inside-out holder and grasps the top end 24 of the holder that does not turn inside-out, because it is prevented by the towel attachment assembly 23, and pulls the bottom end of the holder back over the towels and, by this action, the inside surface 21*b* is turned in; in other words the holder is turned inside-in or re-reversed to again protect the towels from falling rain.

The towel attachment assembly shown in all of the Figures and denoted 3 in FIGS. 1 to 6, denoted 13 in FIG. 7 and denoted 23 in FIGS. 8 and 9 is the same in all of these embodiments and is an example of a particularly suitable attachment assembly, because: it securely holds the towels at the closed end of the holder; it enables readily attaching and detaching the towels; it is a simple strong structure easily installed with conventional tools and it provides a reinforced hole on the outside of the holder by which to attach the holder to the users belt, strap, golf bag or cart so that the dry towel contained therein is readily available to the user.

Figure 4:
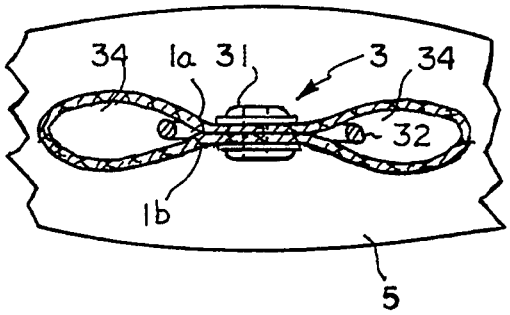
FIG. 4 is an enlarged cross-section view of the top of the combination towel and towel holder taken as shown in FIG. 1, showing the holder grommet, the annular space defined by the grommet and the ring contained in the annular space.

For these purposes also, the assembly includes the holder grommet 31, captured ring 32 and towel grommet 33, all shown in FIG. 1. An enlarged, broken away top view in FIG. 4 shows the holder grommet 31 and ring 32, the ring being captured in an annular space 34 inside the holder defined by the holder grommet and the closed top end 4 of the holder, when the grommet is inserted and secured in place from outside the holder. Ring 32 may be similar to a well-known shower curtain ring having a ring part 32*a* and a projecting part 32*b* that can be opened and closed to accommodate attaching the towels thereto. For that purpose one or more of the towels may be attached at their top ends by a towel grommet such as towel grommet 33, or each towel may have such a towel grommet by which the towel or towels are removably attached to the captured ring.

Figure 5:
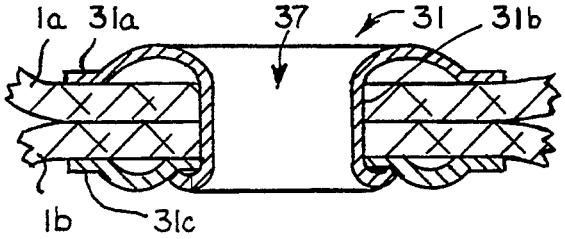
FIG. 5 is a greatly enlarged view of the holder grommet, which is installed and secured from the outside of the holder.
Figure 6:
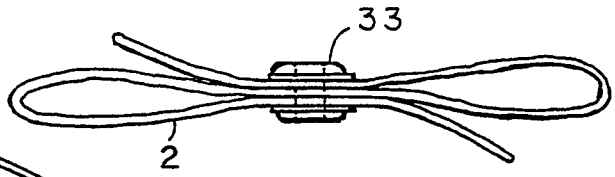
FIG. 6 is an enlarged top view of the towel folded twice and with a towel grommet attached thereto through the folds for attaching the towel to the ring inside them holder.
Figure 2:
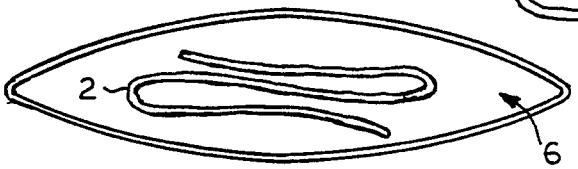
FIG. 2 is a bottom view of the combination towel and towel holder.
Figure 3:
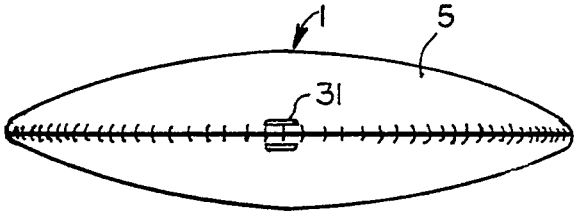
FIG. 3 is a top view of the combination towel and towel holder.

A greatly enlarged view of holder grommet 31 is shown in FIG. 5 revealing a typical well known grommet structure including the grommet flange 31*a*, grommet post 31*b* and grommet washer 31*c*, assembled to pin together two layers 1*a* and 1*b* of the holder material at the top closed end of the holder. The grommet is installed in a well-known way by first punching a hole through the two layers 1*a* and 1*b*, then inserting the grommet post through the punched holes up to the flange on side 1*a*, then placing the grommet washer on the projecting post on the other side 1*b* and applying the grommet usual mounting tools to both sides to deform the post as shown, securing the flange to the washer and providing a reinforced hole 37 through the two layers 1*a* and 1*b*. Reinforced hole 37 is used by the user to carry the towel-holder combination as described herein.

The towel grommet 33 can be the same as holder grommet 31 and accommodates attaching the towel or towels to the captured ring. As mentioned above the ring can be a conventional type of shower curtain ring is usually spring loaded open and can be closed with the fingers. While this sort of ring is preferred herein, it could be replaced by a simple hook using the same arrangement of holder grommet to capture the ring in an annular space defined at the closed top end 4 of the holder when the grommet is installed.

While the invention described herein is described in connection with several embodiments, it will be understood that it is not intended to limit the invention to those embodiments. It is intended to cover all alternatives, modifications, equivalents and variations of those embodiments and their features as may be made by those skilled in the art within the spirit and scope of the invention as defined by the appended claims.

We claim:

1. In a towel and towel holder combination for providing a towel that is protected by a holder from falling rain including a towel, a towel holder having a top end and a bottom end, said towel holder defining a space between said top and bottom ends thereof that is protected from falling rain, means for attaching said towel thereto, so that said towel is contained within said defined space and there is an access opening to said space at said bottom end, the improvement comprising, said towel holder having an inside surface and an outside surface, wherein said outside surface is water repellant and said inside surface is comprised of water absorbing material, whereby said towel holder turned inside-out can be used as a towel.

2. A towel comprising, a generally tubular shaped hollow body having two ends and formed of flexible material and so defining an inside surface and an outside surface, said tubular shape being substantially closed at one end and substantially open at the other end, said outside surface being substantially water repelling and said inside surface being substantially water absorbing, whereby said inside surface is protected from water impinging against said outside surface and said water absorbing surface serves as a towel when said tubular shaped body is turned inside-out.

3. A towel as in claim 2 wherein said material is sufficiently resilient that said generally tubular shaped body having been turned inside-out can be readily turned inside-in to protect said water absorbing surface from water impinging on said water repelling surface.

* * * * *